US011686540B2

(12) United States Patent
Bilgeri

(10) Patent No.: US 11,686,540 B2
(45) Date of Patent: Jun. 27, 2023

(54) BREECHBLOCK FOR A FIREARM

(71) Applicant: GLOCK TECHNOLOGY GMBH, Ferlach (AT)

(72) Inventor: Elmar Bilgeri, Klagenfurt (AT)

(73) Assignee: Glock Technology GmbH, Ferlach (AT)

( * ) Notice: Subject to any disclaimer, the term of this patent is extended or adjusted under 35 U.S.C. 154(b) by 0 days.

(21) Appl. No.: 17/753,558

(22) PCT Filed: Sep. 29, 2020

(86) PCT No.: PCT/EP2020/077186
§ 371 (c)(1),
(2) Date: Mar. 8, 2022

(87) PCT Pub. No.: WO2021/063923
PCT Pub. Date: Apr. 8, 2021

(65) Prior Publication Data

US 2022/0333882 A1 Oct. 20, 2022

(30) Foreign Application Priority Data

Oct. 4, 2019 (EP) ..... 19201440

(51) Int. Cl.
*F41A 3/66* (2006.01)
*F41A 3/26* (2006.01)
*F41A 5/18* (2006.01)

(52) U.S. Cl.
CPC ..... *F41A 3/26* (2013.01); *F41A 3/66* (2013.01); *F41A 5/18* (2013.01)

(58) Field of Classification Search
CPC ..... F41A 3/26; F41A 3/66; F41A 3/64; F41A 5/18
See application file for complete search history.

(56) References Cited

U.S. PATENT DOCUMENTS

| | | | | |
|---|---|---|---|---|
| 9,995,542 | B1 | 6/2018 | Sahin et al. | |
| 11,035,632 | B1 * | 6/2021 | Sugg | F41A 3/26 |
| 2018/0172373 | A1 * | 6/2018 | Maranli | F41A 3/26 |
| 2019/0195580 | A1 * | 6/2019 | Leitner-Wise | F41A 3/16 |
| 2019/0195581 | A1 | 6/2019 | Cassels | |
| 2020/0333094 | A1 * | 10/2020 | Overstreet | F41A 19/30 |

FOREIGN PATENT DOCUMENTS

| | | | |
|---|---|---|---|
| EP | 0423678 | A2 | 4/1991 |
| EP | 1718914 | A2 | 11/2006 |

OTHER PUBLICATIONS

International Search Report, PCT/EP2020/0077186, dated Dec. 18, 2020.

* cited by examiner

*Primary Examiner* — J. Woodrow Eldred
(74) *Attorney, Agent, or Firm* — Raven Patents, LLC; Anton E. Skaugset

(57) ABSTRACT

Breechblocks for firearms, the breechblocks including a barrel axis and a barrel extension, including a bolt with cam pin and cam pin axis, and a bolt carrier which has at least one end face and an assembly groove and a substantially S-shaped cam slot with a locked position and an unlocked position, wherein the assembly groove at the locked position of the cam slot is subsequently formed substantially from behind in the forward barrel direction and is essentially U-shaped.

19 Claims, 7 Drawing Sheets

BREECHBLOCK FOR A FIREARM

TECHNICAL FIELD

The present disclosure relates to firearms, and more particularly to a breechblock for a firearm, where the breechblock includes at least one bolt with a cam pin and a bolt carrier with an assembly groove and cam slot, and where the bolt and the bolt carrier are connected to one another such that they can be slid into one another and are detachable.

BACKGROUND

Firearms with a rotating bolt have long been known. Examples include the types M4/M16/AR15, and their derivatives. In the case of these weapons, the breechblock comprises a bolt carrier arranged movably in the receiver, or also called a breechblock carrier, as well as a bolt that can be rotated and displaced about the barrel axis in the bolt carrier.

During the locking process, the bolt is usually rotated by the interaction of a cam pin (or guide cam, sometimes also referred to as a sliding block), which is arranged on the bolt, with a cam slot or groove, which is arranged in the bolt carrier. The cam slot (also called guide cam) is often designed as a closed, elongated, substantially S-shaped groove with a helical or spiral-shaped section. The helical section causes the rotational movement of the bolt by interacting with the cam pin when the bolt moves relative to the bolt carrier.

A common solution is to manufacture the cam pin as a separate component. It is inserted in a transverse bore in the bolt and held there in position, for example, by the firing pin located in the firing pin bore. During assembly, the bolt is pushed into the bolt carrier, then the cam pin is inserted into the bolt through the closed cam located inside the bolt carrier. The cam pin is often secured against falling out by the firing pin. Since the cam pin requires a corresponding material thickness to absorb the forces during the locking process, only thinner wall thicknesses of the bolt remain in the region of the transverse bore for the cam pin. This results in a relative weakening of the bolt and breaks repeatedly occur at this point in known bolts of this type.

To avoid bolt breakage, the cam pin can be attached integrally to the bolt. For example, such a bolt with an integral cam pin can be inserted into a split bolt carrier, so that the cam pin is brought into the closed cam during assembly. It is then necessary to secure the bolt in the bolt carrier with clips, slides or similar elements. Because of the complex geometries required, the manufacture of such split bolt carriers requires a very high level of manufacturing effort. In addition, due to the large number of components, the assembly of such a bolt in the bolt carrier is at the expense of user-friendliness.

Other variants are known, for example, from the AK47 weapon family. A bolt carrier that is open at the bottom only partially encompasses the bolt, which can be rotated from below, while the return movement is guided by the locking lugs. The relatively large structural shape of the components, however, necessitates large movable locking masses, and the breechblock also has a relatively large angle of rotation. The force of the gas piston, which is transmitted via a piston rod, acts eccentrically on the top due to the design of the breechblock which is open at the bottom.

EP 0423678 A2 describes a breechblock with a cam that is open to the front and extends in the circumferential direction to the rear; the bolt is secured in the bolt carrier or the cam pin in the cam slot via a separate, small-scale component that is secured by means of a pin. Assembly and disassembly are only possible using tools.

EP 1718914 A2 describes a bolt carrier with a cam that is open to the front and extends to the rear, wherein a push rod acts, among other things, on the cam pin. The small areas on which the push rod acts and the eccentric force transmission have a disadvantage. The breechblock described also has a fixed ejector, which requires a lateral slot in the bolt carrier. This slotted design of the bolt carrier has an unfavorable effect on the mechanical stability, which in turn increases the risk of breakage.

What is needed is a precise and mechanically highly resilient breechblock, that in addition is constructed as simply as possible, that is to say with preferably as few components as possible, and that can be disassembled without tools. Furthermore, in the built-in state, the coupling of the bolt with the bolt carrier should be break proof.

SUMMARY

The present disclosure is directed to breechblocks for firearms that include at least a bolt with a cam pin and a bolt carrier, where the bolt carrier has an end face and an assembly groove and a substantially S-shaped cam slot with locked position and unlocked position, where the assembly groove adjoins the locked position of the cam slot and is substantially U-shaped.

In one example, the present disclosure includes a breechblock for a firearm, where the firearm includes a barrel axis and a barrel extension, and the breechblock includes a bolt with a cam pin and a cam pin axis; a bolt carrier, the bolt carrier having at least one end face, an assembly groove, and a substantially S-shaped cam slot with a locked position and an unlocked position; where the assembly groove is substantially U-shaped or J-shaped with two legs that are substantially oriented in the direction of the barrel axis; and that one of the two legs of the U-shaped assembly groove, or a shorter leg of the J-shaped assembly groove, adjoins the locked position of the cam slot substantially from behind relative to a forward barrel direction.

BRIEF DESCRIPTION OF THE DRAWINGS

The breechblocks of the present disclosure are explained in more detail with reference to the drawings, in which.

DETAILED DESCRIPTION

Figure 1:
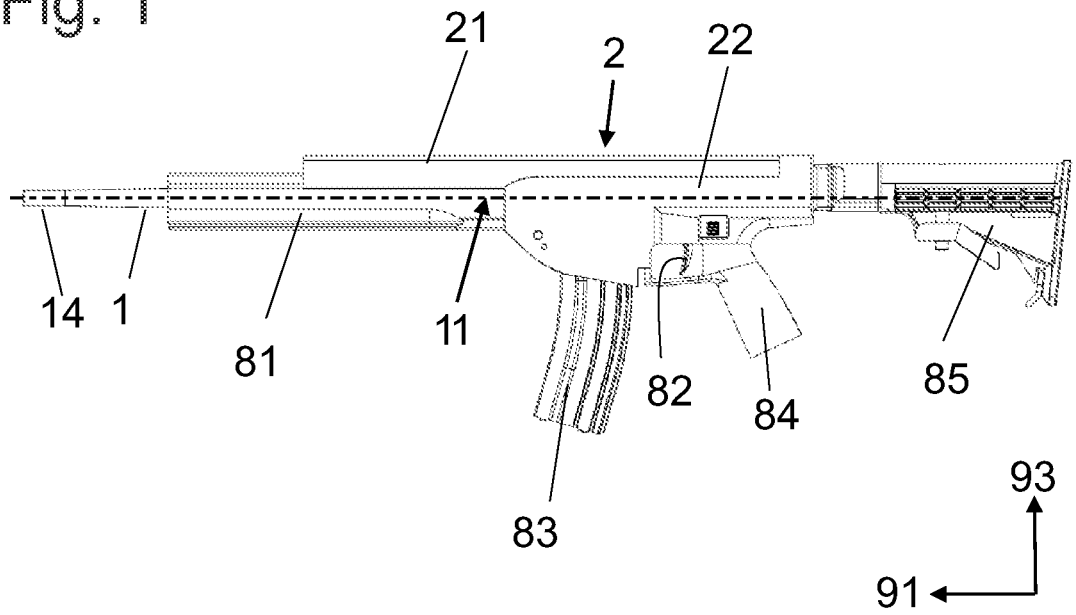
FIG. 1 is a simplified side view of a representative firearm.

S-shaped cams are known from the prior art. When the breechblock is unlocked, the cam pin is in a forwardly closed unlocking section of the cam slot, in the unlocked position. When the breechblock is completely locked, the cam pin is in the locked position in the rear so-called locking section of the cam slot. The locking section and the unlocking section are connected to one another by a helical, or spiral-shaped, central section.

According to the present disclosure, the essentially U-shaped assembly groove begins on the end face of the bolt carrier in the barrel direction toward the rear and ends at the rear end of the cam slot and adjoins it. An assembly groove that merges into the cam slot in this way has the advantage that the bolt together with the cam pin can be inserted into the bolt carrier along the assembly groove. It is therefore easily possible to move the cam pin into the cam slot so that the bolt is in an operational state. The bolt and cam pin can be assembled before they are inserted into the bolt carrier. With the aid of an assembly groove and cam slot formed in this way, it is also possible for the cam pin to be formed integrally on the bolt. In addition, a high material thickness of the bolt carrier remains, for example on the end face for the, preferably symmetrical, interaction with a gas linkage, or also in the lateral and vertical direction, which promotes the stability of the bolt carrier. Furthermore, the number of components can be reduced compared to known bolt carriers. At the same time, tool-free disassembly/assembly of the bolt is promoted.

It has proven to be particularly advantageous that the assembly groove has a first section, which extends backward starting at the end face, and a second section adjoining the first section, which extends in the circumferential direction and a third section adjoining the second section which extends forward.

The U-shaped assembly groove with a first rearwardly extending section allows an easy and a simple introduction of a bolt with cam pin, wherein the cam pin is guided in the first section of the assembly groove. When the second section is reached, the bolt is rotated in the direction of the third section, with the cam pin being guided in the second section. When the third section is reached, the bolt is moved forward again in the barrel direction and the cam pin is guided in the third section. The first, second and/or third section can be straight or also helical or spiral-shaped. It has proven to be particularly advantageous to design the second and/or third section in a spiral shape. It is relatively easy for the user—even without a direct line of sight—to see in which section the cam pin is located. Due to the design of the assembly groove according to the invention, it is not necessary to secure the bolt in the bolt carrier, for example by means of further components.

In addition, in a special embodiment, the third section of the assembly groove can be viewed in the running direction and can extend to the rear adjacent to the locked position of the cam slot. It has proven to be advantageous that the third section extends backward 0.1 to 3 times the diameter of the cam pin, preferably 0.5 to 1.5 times the diameter of the cam pin. This measure has the advantage that the bolt has to be moved backward at least partially from the locked position of the cam slot in order to bring the cam pin into the assembly groove and then to be able to remove the bolt from the bolt carrier. However, unintentional twisting of the bolt into the second section of the mounting groove directly from the locked position is not possible. Additional components to prevent unintentional twisting can thus be avoided.

Furthermore, a special embodiment is advantageous in which the first section is oriented parallel to the barrel axis since this particularly facilitates production.

Furthermore, it is advantageous to design the second section as a circular arc segment viewed from above, which, viewed from above, is oriented normally to the barrel axis, since the relatively simple manufacture and easy recognition of the position of the cam pin during insertion is also given. In a similar manner, it can be particularly advantageous to design the third section oriented parallel to the barrel axis.

An assembly groove designed in this way can substantially be viewed as U-shaped and is particularly easy to manufacture, for example by means of drilling and/or milling. The above-mentioned possibilities of forming individual or all of the three sections in a spiral shape can result in the need to use additive manufacturing processes.

The straight backward-running assembly groove allows maximum use of space in the bolt carrier while maintaining the integrity of the bolt. The cam pin can have a correspondingly long length, which is advantageous when interacting with the cam slot.

The aforementioned designs are also advantageous with regard to simple assembly.

In a borderline case, the three sections are each formed approximately at right angles to one another, whereby the description of the following situation can also be read analogously for any spiral sections: The bolt is guided straight back with the cam pin in the first section until the cam pin strikes the end of the first section. This position, which is easy to determine, is followed by a rotation of the bolt with the cam pin in the second section of the cam slot up to the stop at the end of the second section. Now the bolt is brought forward into the third section and then into the cam slot.

In addition, it has proven to be particularly advantageous if the assembly groove and the cam slot have the same width at the locked position. The transition from the assembly groove to the cam slot is thus stepless and allows the cam pin to be introduced particularly easily from the assembly groove into the cam slot. This design is also particularly advantageous in production, since the assembly groove and the cam slot can be machined, for example milled, in one go at the locking position. This reduces work steps and costs in production.

Another special embodiment can be designed in such a way that the cam pin axis of the cam pin is arranged in the assembly position in the first section of the assembly groove at an angle $\alpha$ to the weapon center plane, wherein the angle $\alpha$ is 20° to 65°, preferably 35° to 45°, and the cam pin axis of the cam pin in the unlocked position at the front, closed end of the cam slot is at an angle $\gamma$, to which the cam pin axis of the cam pin is in the assembly position, wherein the angle $\gamma$ is 50° to 120°, preferably 80° to 100°.

This arrangement of the assembly position and the unlocked position allows a bolt carrier with very high integrity, in particular on the end face where there is sufficient space for interaction with a push rod, which can also be arranged centrally around the bolt. A purely "internal" assembly groove can thus be formed on the bolt carrier, which has a positive effect on the mechanical load-bearing capacity of the bolt carrier. At the same time, the internal mounting groove allows a defined, necessary rotary movement to guide the bolt into the cam slot.

In a further special embodiment, the bolt carrier has at least one guide groove on the side, which is designed to guide the bolt carrier along a guide rail in a receiver, preferably an upper receiver part, wherein the guide groove intersects the cam slot and exposes it upward.

This arrangement of the guide groove in the bolt carrier is particularly advantageous since the bolt carrier can be guided precisely along the guide rail in the receiver. Furthermore, this embodiment allows a guiding window formed in the guide rail to release the rotary movement of the bolt, in addition to guiding in the cam slot, only when the cam pin can reach "through" the guide rail when the bolt is rotated through the control window. The arrangement of the guiding window is designed in such a way that this rotary movement for locking the breechblock can only take place when the breechblock is in the barrel extension of the firearm. If the breechblock with the bolt carrier is in a different, unlocked state, the interaction of the guide rail and cam pin prevents the bolt from rotating. In this way, the bolt can be prevented from rotating unintentionally in the unlocked state and moving into the locked position, since the guide rail prevents the cam pin from entering the helical central section of the cam slot. This is particularly advantageous, since jamming of the weapon can be avoided.

Furthermore, it has been found to be particularly advantageous if the cam pin is designed as a tapered surface at its outer end—viewed in the radial direction to the barrel axis—which in the unlocked position is parallel to the guide rail and is arranged flush with the guide groove. Through this tapered surface, the cam pin can—at least on one side—achieve a maximum length, which has an advantageous effect on the movement in the cam due to the leverage effect. Furthermore, the contact surface (sliding surface) is enlarged by the surface of the cam pin, which is designed as a tapered surface, when it interacts with the guide rail, and a low overall height of the bolt carrier is promoted.

In another, special embodiment, the cam pin is attached integrally to the bolt and preferably has a concave recess in the transition region between the bolt and the cam pin. An integral cam pin has a positive effect on the mechanical load-bearing capacity of the bolt and the number of components required for a firearm can be reduced. In the transition region of the cam pin to the bolt body, a preferably circumferential clearance can be provided. This clearance can be concave, preferably lenticular. Such a transition region from the bolt to the cam pin can reduce the notch effect in the transition area and avoid the risk of the cam pin breaking.

In yet another and particularly advantageous embodiment, a firing pin is arranged in a firing pin bore in the bolt in such a way that a firing pin spring arranged around the firing pin is supported on the bolt head and preloads the firing pin. In the assembled state, the firing pin is supported by the spring preload on the bolt carrier in such a way that the cam pin on the bolt head can only be moved from the cam into the assembly groove against the spring force of the firing pin spring. This is particularly advantageous because the breechblock, assembled but not necessarily built into the firearm, cannot be brought into the assembly groove against the spring preload without moving the bolt backward. This acts as an anti-disintegrant for the assembled breechblock.

Although the breechblocks of the present disclosure are described in the context of a rifle, it should be appreciated that disclosed breechblocks are suitable for a variety of firearms, therefore generally also for pistols. Further components of the firearm, such as the barrel, cartridge chamber, barrel extension with barrel locking lugs, firing pin and firing pin spring, magazine well/holder or buttstock/shaft are not explained in more detail here, since it does not concern the essence of the present disclosure and the person skilled in the art, if at all necessary or, if desired, can also make modifications simply on the basis of their specialist knowledge.

In the present disclosure the terms left, right, up, down, front and back always refer to the firearm from the point of view of the firearm when it is held ready to fire. The weapon has, going through the barrel axis and oriented vertically, what is subsequently referred to as a weapon center plane 90, which cum grano salis, forms a plane of symmetry. In the figures described below, the forward barrel direction is indicated by the arrow 91, the normal (perpendicular) vertical direction by the arrow 93 and the transverse direction to the left by the arrow 92.

In the description and the claims, the terms "front," "rear," "above," "below" and so on are used in the generally accepted form and with reference to the object in its usual use position. This means that, for the firearm, the mouth of the barrel is "at the front," that the breech is moved "rearward" by the explosive gas, etc. Transverse to a direction substantially means a direction rotated by 90°.

The breechblock of a firearm comprises a bolt carrier, a bolt and a firing pin and requires barrel locking lugs of a barrel extension, which are usually connected to the barrel. For the sake of simplicity and better readability, the combination of bolt carrier with bolt (possibly with firing pin and firing pin spring) will also be referred to as the breechblock.

If the breechblock is in the assembled state (or in the following also with the bolt assembled), the parts of the breechblock such as bolt and bolt carrier are functionally connected to one another and form a unit, but the breechblock is not necessarily built into the firearm. If the breechblock is built into the firearm and functionally connected to it, this is referred to as the built-in state or when the bolt is built-in. The firearm is then typically in an operational state. If the bolt is locked (in the locked state or when the bolt is locked), the bolt head interacts with the barrel locking lugs and locks the cartridge chamber toward the rear of the barrel, so that the weapon is ready to fire. If the lock is unlocked (in the unlocked state) the bolt no longer interacts with the barrel locking lugs and is in a rearward position.

In FIG. 1 is shown schematically a firearm, which may comprise a barrel 1 with barrel axis 11 and muzzle 14, a receiver 2 with the upper receiver part 21 and the lower receiver part 22, a handguard 81, a trigger 82, a magazine well/holder 83, a grip 84 and a buttstock/shaft 85.

Figure 2:
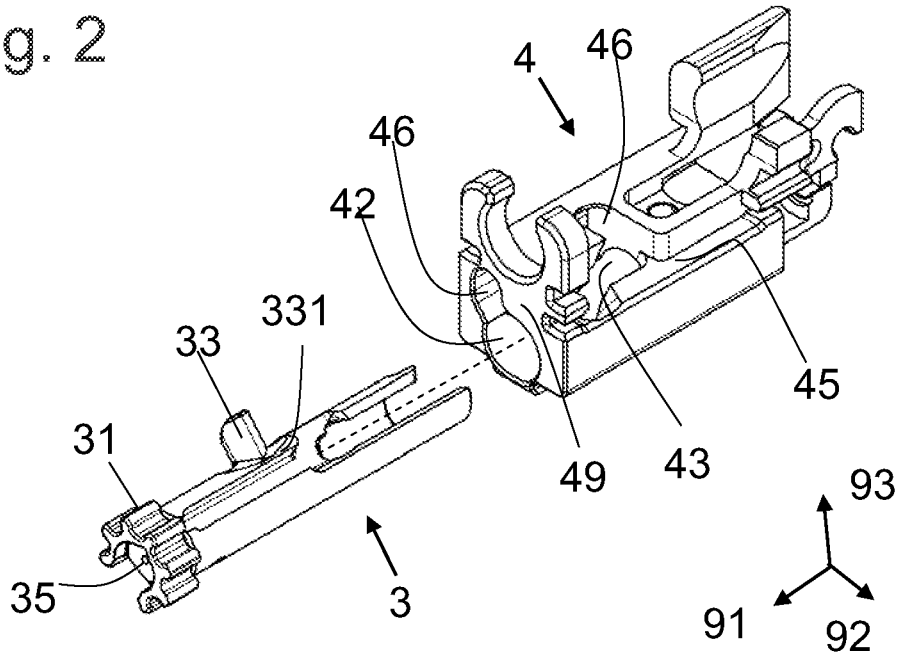
FIG. 2 is a simplified exploded view of an exemplary bolt carrier with a bolt according to the present disclosure, viewed obliquely from the front.

FIG. 2 shows an exploded view of a bolt carrier 4 according to the present disclosure with a bolt 3, hereinafter also referred to as a breechblock for the sake of simplicity and better readability. The elongated bolt 3 has a firing pin bore 35 running in the axial direction and locking lugs 31 formed radially outward at the front end. The preferably integrally formed cam pin 33 extends radially outward, the transition region of the bolt 3 to the cam pin 33 is formed as a concave recess 331, preferably lens-shaped.

The bolt carrier 4 comprises a longitudinal bore, referred to as the bolt receptacle 42, which is used to receive the bolt 3. At least one end face 49 is formed at the front end, which can interact with a push rod of a gas extraction system in order to bring the breechblock back after a shot has been fired during the automatic reloading process. The bolt carrier 4 further comprises, at least on one side, a lateral guide groove 45 which interacts with a guide rail 25 of a receiver 2 and guides the breechblock in the receiver 2 in the axial direction (see FIGS. 5A and 5B). Starting at the end face 49, a rearwardly extending assembly groove 46 is formed along the bolt receptacle 42, which, when the bolt 3 is inserted into the bolt receptacle 42, receives the cam pin 33 and guides the bolt 3. The assembly groove 46 merges into a cam slot 43; details on this are explained in a further sequence and in particular in FIGS. 6 and 7.

Figure 3A:
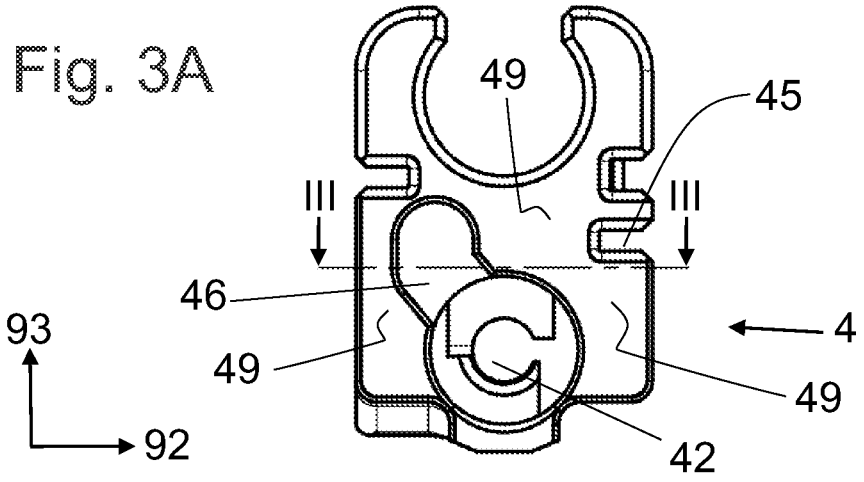
FIGS. 3A and 3B depict a partially cut-out receiver with the bolt carrier and bolt in the unlocked and locked state as a 3-D view.
Figure 3B:
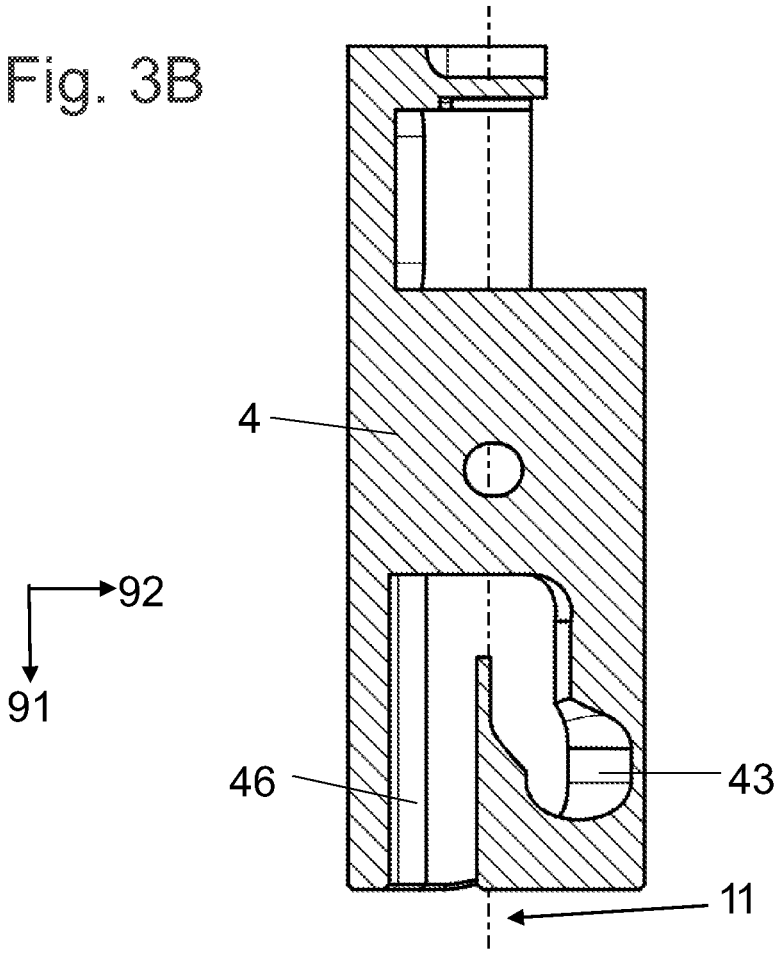

In FIG. 3A, the bolt carrier 4 is shown as a top view from the front. The end face 49 and the guide groove 45 (preferably formed on both sides) are clearly visible. The bolt receptacle 42 and the assembly groove 46 are located on the inside. A longitudinal section of the bolt carrier 4 along the section plane III is shown in FIG. 3*b*. The assembly groove 46, which merges into the cam slot 43, is clearly visible (see also FIG. 4B).

The bolt carrier 4 has a high structural integrity and stability, the bolt 3 located in the bolt carrier 4 is partially enclosed on its central part in the longitudinal direction when built in and completely enclosed in the circumferential direction, and the forces coming from the push rod can be transmitted over a large region at the end face 49.

Figure 4A:
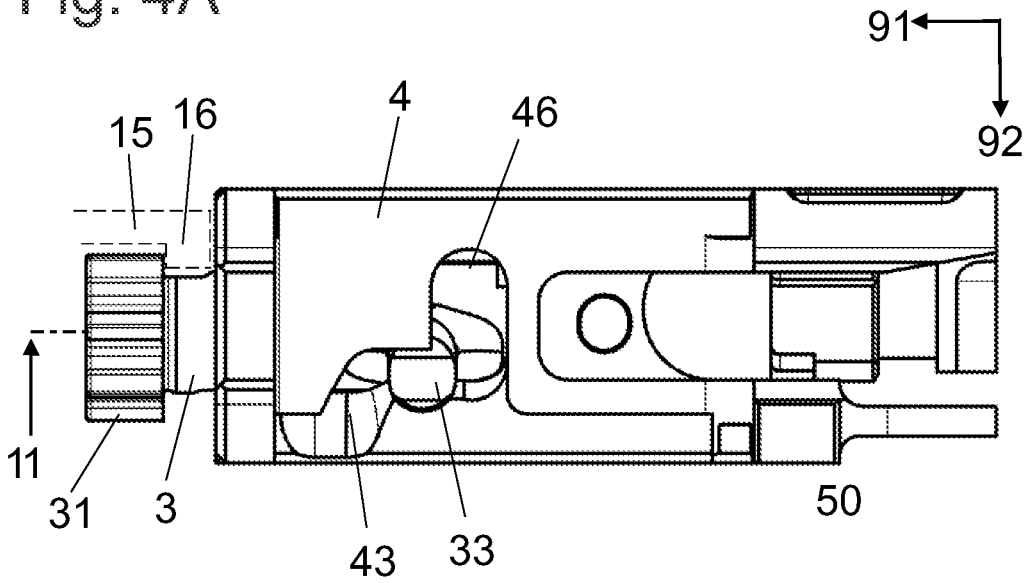
FIGS. 4A and 4B show the cross sections, corresponding to FIGS. 3A and 3B, of a receiver with bolt carrier and bolt along the cam pin axis in the unlocked and locked state.

FIG. 4A shows the position of the bolt 3 in the bolt carrier 4 when the breechblock is locked. The bolt 3 lies in the bolt carrier 4 in such a way that the cam pin 33 lies in the cam slot 43 or partially protrudes through it. For a better understanding, the barrel extension 15 with the barrel locking lugs 16 of a barrel group is indicated by dashed lines. In the built-in and locked state, this position of the bolt 3 in the bolt carrier 4 is the rearmost possible position, since the barrel locking lugs 16 block further movement of the bolt 3 to the rear.

Figure 4B:
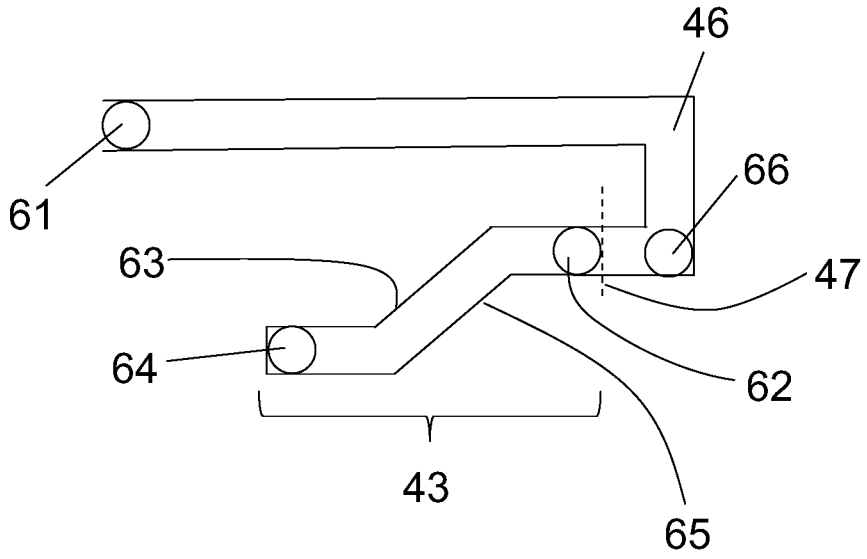

For a better understanding of the following explanations, reference is made to FIG. 4B, in which the U-shaped assembly groove 46 and the S-shaped cam slot 43 are shown schematically. This representation is a planar representation of the projecting position through the cam pin 33 in the respective position along the assembly groove 46 or cam slot 43. As already described above, it can be seen very clearly from this that the U-shaped assembly groove 46, viewed in the forward barrel direction 91, merges into the cam slot 43 from the rear.

The assembly groove 46 has an end that is open to the front and extends from this open end in a first section, preferably at least partially parallel to the barrel axis 11, to the rear. Adjacent to the first section, a second section follows, which is rotated in the circumferential direction, preferably essentially perpendicular to the first section. Adjacent to this is a third section which extends forward, preferably formed at least partially parallel to the barrel axis 11. In the simplified plan view, it becomes clear to the person skilled in the art that the shape of the assembly groove 46 essentially corresponds to a "U" with a shorter leg (or also a "J").

It can also be seen in FIG. 4B that at the transition line 47 the assembly groove 46 merges into the cam slot 43, which extends further forward and, according to the state of the art, is substantially S-shaped with a helical middle section, including a locking cam 65 and an unlocking cam 63. The locking cam 65 and the unlocking cam 63 can be formed parallel to one another or else be formed at different angles on the barrel axis 11. The normal distance between the locking cam 65 and the unlocking cam 63 can correspond to the diameter of the cam pin 33 or in certain cases a multiple thereof.

The front end of the cam slot 43, the so-called unlocking region, is formed substantially parallel to the barrel axis 11 and is closed toward the front and is arranged behind the open end of the assembly groove 46. In this way, the bolt carrier 4 has a relatively high material thickness at its end face 49 in this region. The rear end of the cam slot 43, which adjoins the assembly groove 46, is designed substantially parallel to the barrel axis 11. The width of the assembly groove 46 and that of the cam slot 43 are preferably the same and substantially correspond to the diameter of the cam pin 33.

From what has been described above, it can be seen that the third section of the assembly groove 46, viewed in the forward barrel direction 91, extends further back than the cam slot 43, namely 0.1 to 3 times the diameter of the cam pin 33, preferably 0.5 to 1.5 times.

The assembly position 61 shows the position of the cam pin 33 adjacent to the open end of the assembly groove 46, so to speak the first position of the cam pin 33 in the assembly groove 46 when assembling the breechblock. The locked position 62 shows the position of the cam pin 33 in the locking region of the cam slot 43 when the breechblock is locked. The locked position is directly adjacent to the imagined transition line 47, shown in dashed lines, and is the rearmost possible position of the cam pin 33 in the cam slot 43 (cf. FIG. 4A).

The unlocked position 64 shows the position of the cam pin 33 in the unlocking region of the cam slot 43 when the breechblock is unlocked. The unlocked position 64 is directly adjacent to the closed front end of the cam slot 43 and is the foremost possible position of the cam pin 33 in the cam slot 43. The disassembly position 66 shows the position of the cam pin 33 in a rearmost possible position in the assembly groove 46. The distance between a locked position 62 and a disassembly position 66 is in the range from 0.1 to 3 times the diameter of the cam pin 33, preferably 0.5 to 1.5 times, in accordance with the shape of the third section. This shape means that unintentional turning of the bolt 3 out of the locked position 62 (as would be possible with an L-shaped assembly groove) is prevented, since a movement must first be made to the rear in order to reach the disassembly position 66. The U-shape according to the invention therefore provides protection against disintegration, but without the need for a further component.

To assemble the breechblock, the bolt 3 (with firing pin 50 and, if necessary, firing pin spring 51—compare FIGS. 2, 3B and 4B) is introduced at its rear end on the front on the bolt carrier 4 into the bolt receptacle 42 such that the cam pin 33 is guided backward along the assembly groove 46. At the end of the first section of the assembly groove 46, the bolt 3 is rotated in the circumferential direction, so that the cam pin 33 is guided in the second section of the assembly groove 46. At the end of the second section, the bolt 3, and with it the cam pin 33, are brought forward and thus into the third section and further into the cam slot 43. The breechblock is thus in the assembled state.

Figure 5A:
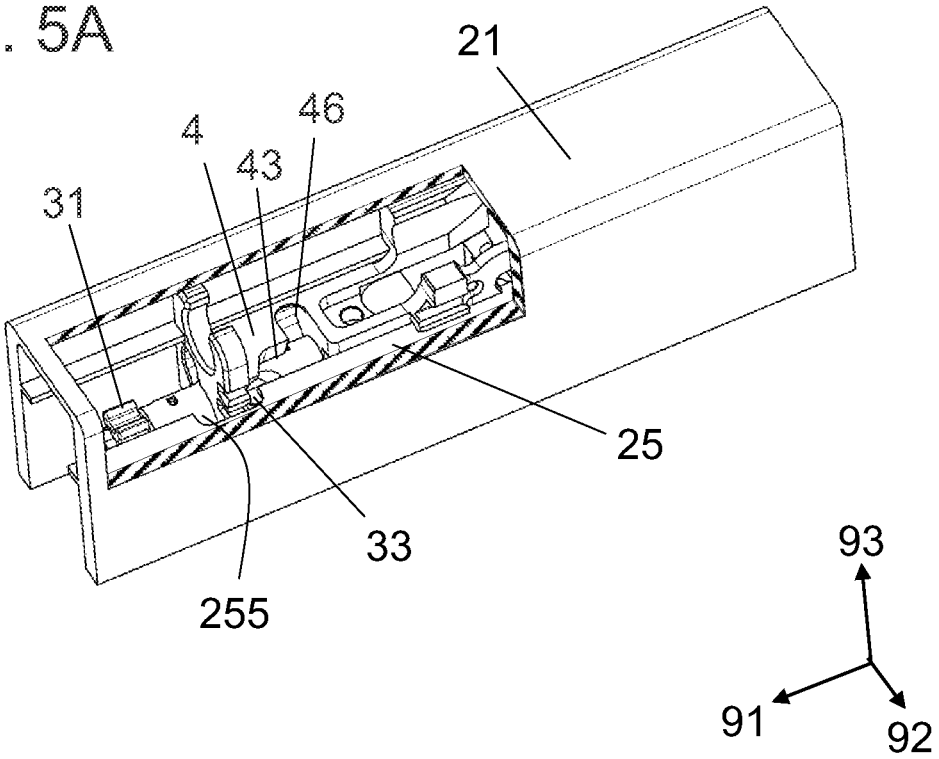
FIGS. 5A and 5B are 3-D views, corresponding to FIGS. 3A and 3B, and 4A and 4B, respectively, of the bolt carrier with bolt in the unlocked and locked state without the receiver.
Figure 5B:
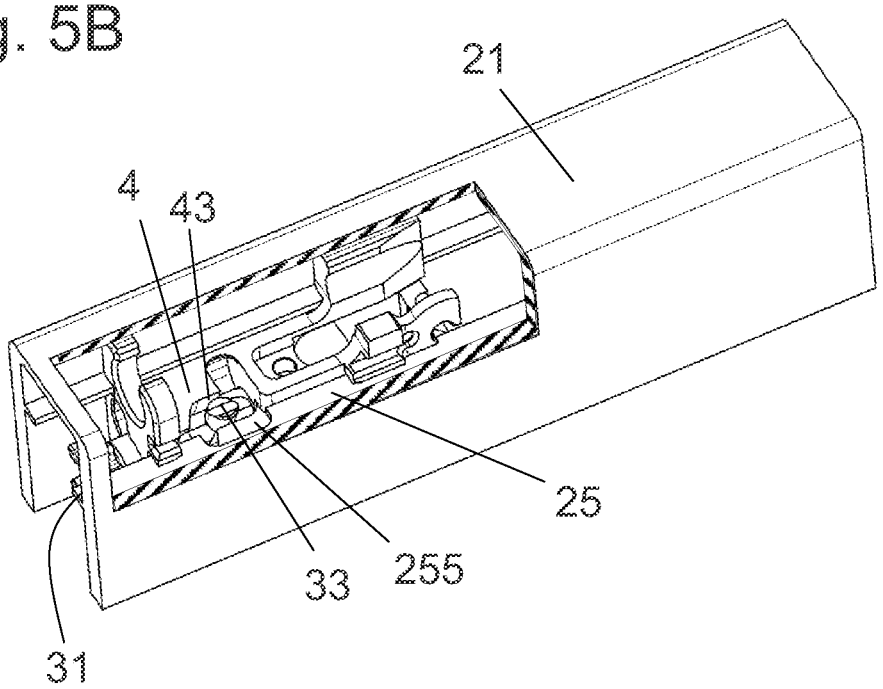

In FIGS. 5A and 5B, the bolt carrier 4 with bolt 3 from FIG. 2 is shown in an upper receiver part 21 of a receiver 2 of a firearm. The housing of the upper receiver part 21 is partially cut out, which enables a clear view of the interaction of the cam pin 33 with the guide rail 25 of the upper receiver part 21. FIG. 5A shows the position of the bolt carrier 4 and bolt 3 in the unlocked state, FIG. 5B shows the breechblock in the locked state, in FIGS. 6A and 6B, corresponding to FIGS. 5A and 5B, cross sections along the cam pin axis and thus the position of the cam pin 33 in the block are shown with an unlocked (FIG. 6A) and a locked (FIG. 6B) breechblock.

Figure 7A:
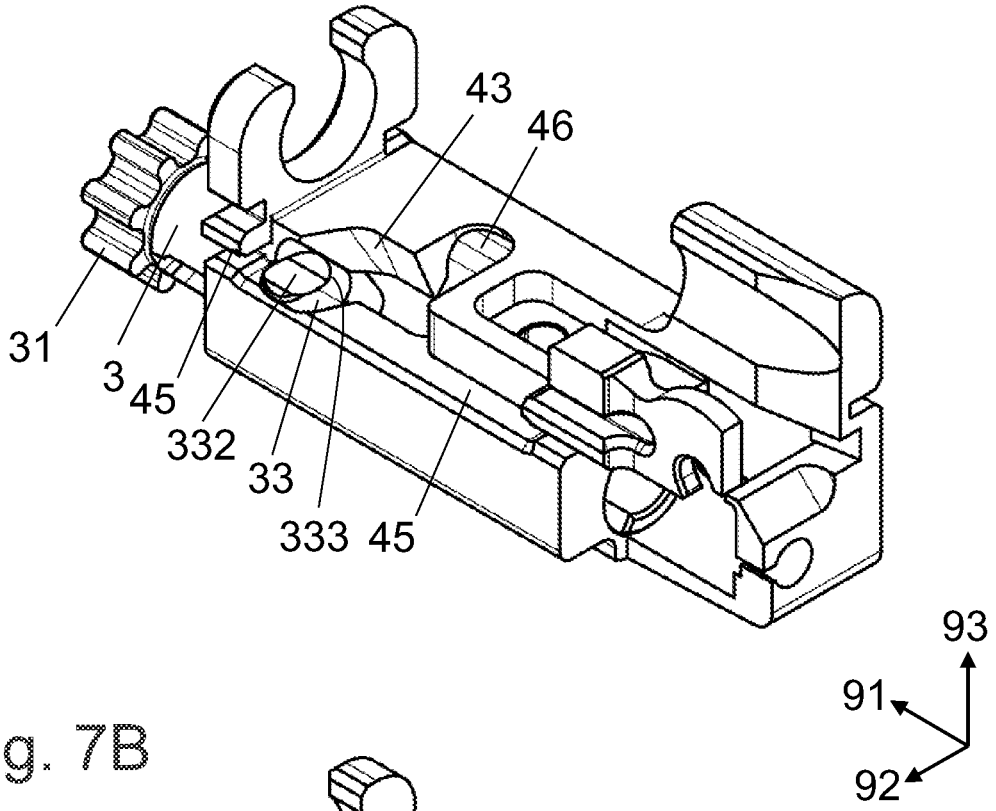
FIGS. 7A and 7B show a top view of the bolt carrier with bolt from above in the locked state with the maximum rear position of the bolt that can be reached in the operating state, as well as a schematic representation of the position of the guide cam in the cam and assembly groove in different positions.
Figure 7B:
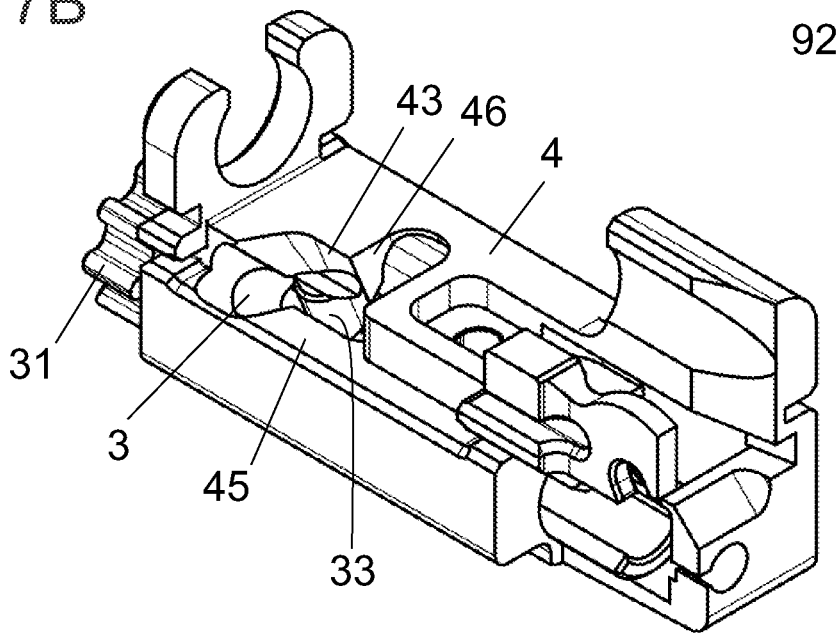

FIGS. 7A and 7B show, in a manner corresponding to FIGS. 5A and 5B, representations of the bolt carrier 4 with bolt 3 without the receiver 2 with the lock unlocked (FIG. 7A) and locked (FIG. 7B). The bolt carrier 4 is arranged in the receiver 2 in such a way that the guide rail 25 of the upper receiver part 21 engages in the lateral guide groove 45 and the bolt carrier 4 can be moved back and forth in the upper receiver part 21. A guide rail 25 is usually formed on both sides of the receiver 2 housing, and the bolt carrier 4 likewise has a corresponding lateral guide groove 45. A guiding window 255 is also formed on a guide rail 25 facing the cam slot 43.

The first section of the assembly groove 46 lies on one side of the weapon center plane 90, the cam slot 43 on the other side. The cam pin 33 is substantially cylindrical with a lateral surface 333 and extends outward in the radial direction of the bolt 3, along the cam pin axis 334. The cam pin 33 is guided on its lateral surface 333 in the assembly groove 46 and the cam slot 43.

Figure 6A:
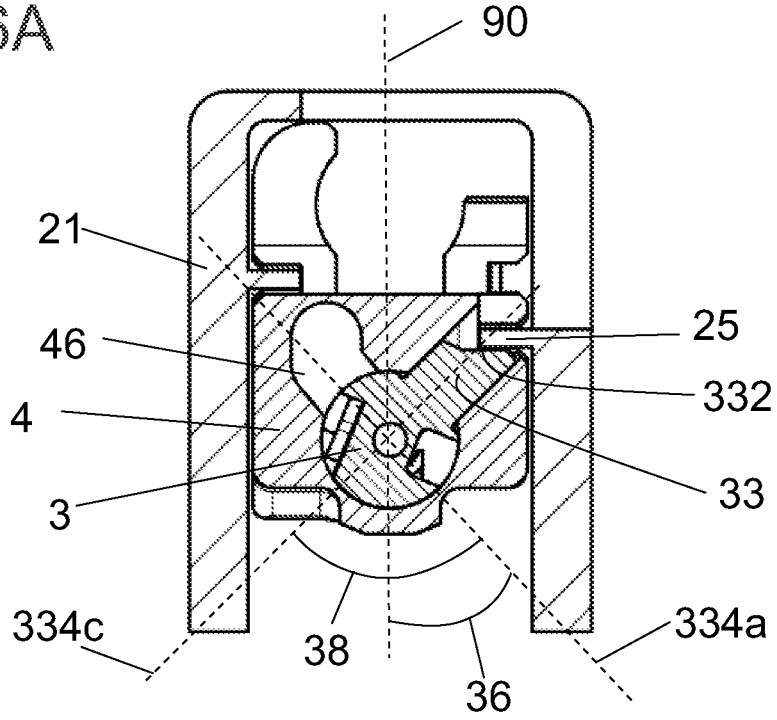
FIGS. 6A and 6B show a top view of the bolt carrier from the front and a corresponding longitudinal section.
Figure 6B:
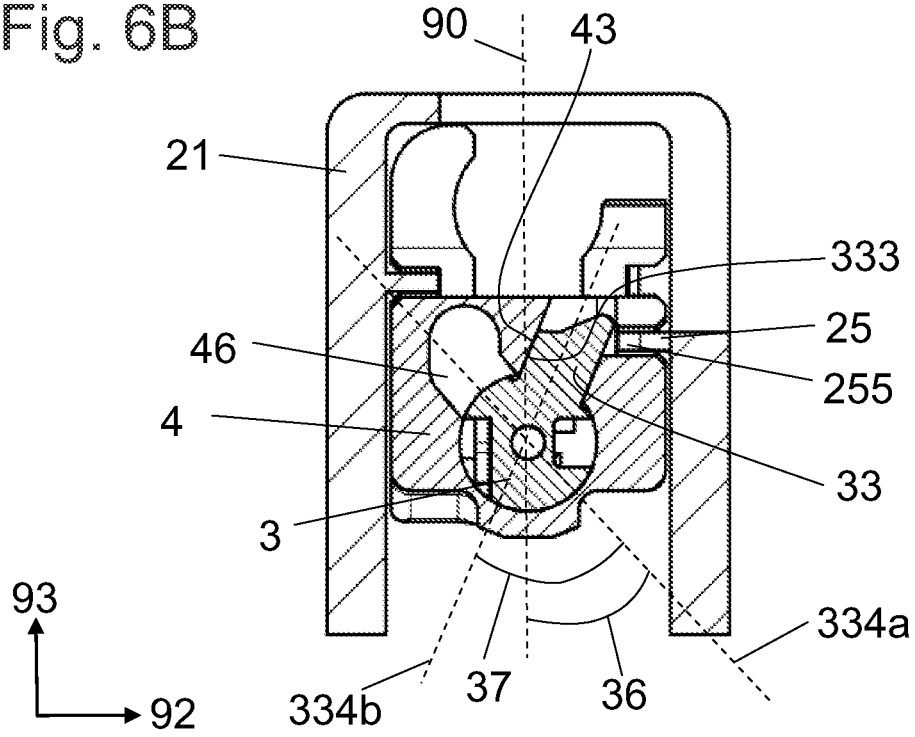

As can be seen from a composite viewing of FIGS. 5, 6 and 7, the outer end of the cam pin 33 can be designed as a tapered surface 332 which is at an acute angle to the cam pin axis 334. The tapered surface 332 can interact with the guide rail 25 of the receiver 2 and, when the lock is unlocked, as can be seen in FIG. 6A, preferably ends flush with the guide groove 45. Rotation of the bolt 3 when the breechblock is unlocked is prevented in this position by the interaction of the cam pin 33 (or its tapered surface 332) with the guide rail 25.

If the breechblock is locked (FIGS. 5B, 6B, 7B), the guide rail 25 has a guiding window 255 at the position of the cam slot 43. The cam pin 33 can reach through this guiding window 255, that is, during the locking process, the cam pin 33 is guided along the helical middle section of the cam slot 43 and rotated in the circumferential direction, which is made possible by the guiding window 255.

As already described, the cam pin 33 extends outward along its cam pin axis 334. In FIG. 6 it can be seen that in the assembly position 61, the cam pin axis 334*a* is at an angle α 36 to the weapon center plane 90. In the locked position 62, the cam pin axis 334*b* is at an angle β 37 to the cam pin axis 334*a* in the assembly position 61. In the unlocked position 64, the cam pin axis 334*c* is at an angle γ 38 to the cam pin axis 334*a* in the assembly position 61.

Angle α 36 can be 20° to 65°, preferably 35° to 45°.

Angle β 37 can be 35° to 90°, preferably 55 to 65°.

Angle γ 38 can be 50° to 120°, preferably 80° to 100°.

The assembly position 61 (and thus angle α 36) is located on one side of the weapon center plane 90, the locked position 62 and unlocked position 64 are usually located on the other side of the side of the weapon center plane 90. The arrangement of the cam pin axis 334*a*, 334*b* and 334*c* with the corresponding angles α, β and γ 36, 37, 38 enables a mechanically stable bolt carrier 4 with high integrity with as much space as possible on the end face 49 for interaction with the push rod (preferably arranged centrally around the bolt) of a gas system.

If the breechblock is built in, in summary, an unintentional entry of the cam pin 33 into the assembly groove 46 is prevented:

When the breechblock is unlocked due to the interaction of the cam pin 33 with the guide rail 25, the cam pin 33 thus remains in the unlocking region of the guide cam slot 43.

When the breechblock is locked due to the interaction of the bolt 3, more precisely the locking lugs 31 with the barrel locking lugs 16 of the barrel extension 15, the cam pin 33 accordingly remains in the locked position 62.

Figure 8A:
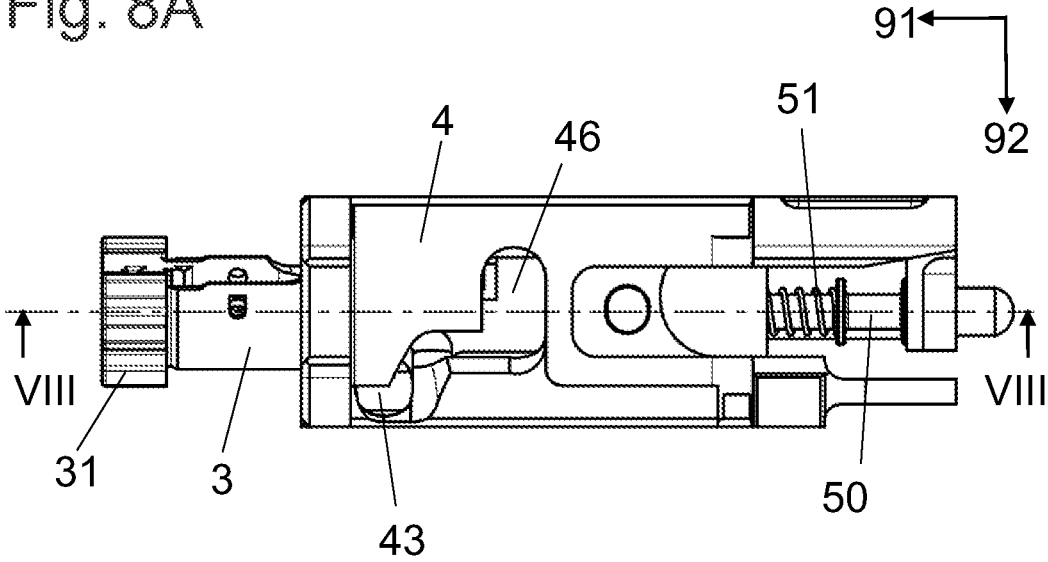
FIGS. 8A and 8B show a side plan view and corresponding longitudinal section of the bolt carrier with bolt and firing pin.
Figure 8B:
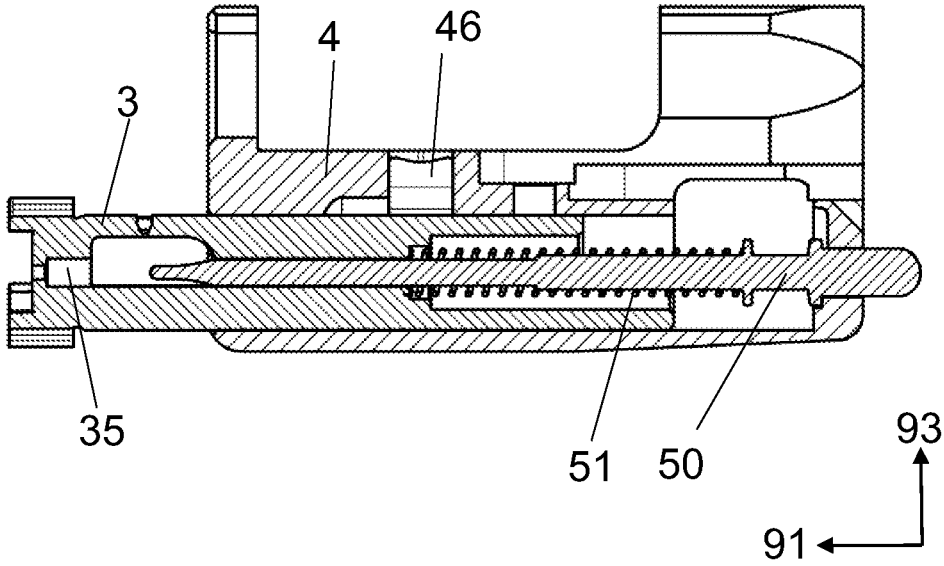

As shown in FIGS. 8A and 8B, the firing pin 50 lies, preferably centrally in a firing pin spring 51, in the firing pin bore 35. The rear end of the firing pin 50 protrudes from the bolt carrier 4 to interact with a striking device, not shown. By means of a collar on the rear section of the firing pin 50, the latter is supported on the inside on the bolt carrier 4, so it cannot fall out to the rear. The firing pin spring 51 can be supported on the firing pin 50 and bolt 3. Since the firing pin 50 is supported toward the rear in the bolt carrier 4, the firing pin spring 51 pushes the bolt 3 forward. In the assembled state, the bolt 3 is thus pushed forward by the spring preload of the firing pin spring 51 in the bolt carrier 4, the cam pin 33 is correspondingly in contact with the front, closed end of the cam slot 43 and is in the unlocked position 62.

To disassemble the breechblock, the bolt 3 in the bolt carrier 4 can be pushed backward against the spring force of the firing pin spring 51, with the cam pin 33 into the disassembly position 66 of the assembly groove 46, and after turning so that the cam pin 33 lies in the first section of the assembly groove 46, can be taken forward from the bolt carrier 4. With such a design, the breechblock according to the invention can be made very robust in the assembled state and can be disassembled without tools if necessary; the breechblock is secured against disintegration in the built-in state only by means of guide rail 25 and without further components.

The: "substantially S-shaped control cam slot 43" has two end portions extending substantially in the direction of the barrel axis 91.

The: "substantially U shaped or J shaped" assembly groove 46 has two legs that extend substantially in the direction of barrel axis 91.

Here, "substantially" means an orientation which, while preferably parallel to the running axis 91, includes a deviation of up to 30°, preferably only 15° for each of the legs or the end sections, respectively, independently of each other.

Here, "U shaped or J shaped" does not necessarily imply termination by an arc, a rectangular formation as shown is also possible. The two legs or end sections do not have to be parallel to each other.

The breechblock of the present disclosure need not be limited to the illustrated and described exemplary embodiments, but can be modified and configured in various ways. In particular, the shown cross-sectional shapes of the mentioned receiver parts, pins, rails, recesses, etc. can be adapted to the given basic data, and the lengths and the positions with respect to the receiver can also be easily adapted by a person skilled in the art with knowledge of the invention. In particular, equivalent designs are obvious with knowledge of the invention and can be carried out without further ado by a person skilled in the art.

It should also be noted that in the description and the claims, terms such as the "lower region" of an object, refer to the lower half and in particular the lower quarter of the overall height; "lowermost region" refers to the lowermost quarter and in particular an even smaller part, while "central region" refers to the central third of the overall height. For the terms "width" or "length," this applies mutatis mutandis. All these terms have their generally accepted meaning, applied to the intended position of the object under consideration.

In the description and the claims, "substantially" means a deviation of up to 10% of the stated value, if physically possible, both downward and upward, otherwise only in the appropriate direction; in the case of degrees (angle and temperature), and for indications such as "parallel" or "normal," this means±10°. If there are terms such as "substantially constant" etc., what is meant is the technical possibility of deviation which the person skilled in the art takes as a basis and not the mathematical one. For example, a "substantially L-shaped cross section" comprises two elongated surfaces, which merge at one end into the end of the other surface, and whose longitudinal extension is arranged at an angle of 45° to 120° to one another.

All given quantities and percentages, in particular those relating to the limitation of the invention, insofar as they do not relate to specific examples, are understood to have a tolerance of ±10%; accordingly, for example: 11% means 9.9% to 12.1%. With terms such as "a solvent," the word "a" is not to be considered to represent a singular numeral, but rather is to be considered an indefinite article or a pronoun, unless the context indicates otherwise.

The term: "Combination" or "combinations", unless otherwise stated, means all types of combinations, starting from two of the relevant components up to a plurality or all of such components; the term "containing" also means "consisting of."

The features and variants stated in the individual embodiments and examples can easily be combined with those of the other examples and embodiments and in particular can be used for characterizing the invention in the claims without necessarily including the other details of the particular embodiment or of the particular example.

The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

LIST OF REFERENCE SIGNS

| | | | |
|---|---|---|---|
| 1 | Barrel | 3 | Bolt |
| 11 | Barrel axis | 31 | Locking lugs |
| 14 | Muzzle | 33 | Cam pin |
| 15 | Barrel extension | 331 | Concave recess |
| 16 | Barrel locking lugs | 332 | Tapered surface |
| 2 | Receiver | 333 | Lateral surface |
| 21 | Upper receiver | 334a | Cam pin axis assembly position |
| 22 | Lower receiver | 334b | Cam pin axis locked position |
| 25 | Guide rail | 334c | Cam pin axis unlocked position (cam pin axis open) |
| 255 | Guiding window | 35 | Firing pin bore |
| 4 | Bolt carrier | 36 | Angle α |
| 42 | Bolt receptacle | 37 | Angle β |
| 43 | Cam slot | 38 | Angle γ |
| 45 | Guiding groove | 50 | Firing pin |
| 46 | Assembly groove | 51 | Firing pin spring |
| 47 | Transition line | 81 | Handguard |
| 49 | End face | 82 | Trigger |
| | | 83 | Magazine well/holder |
| 61 | Assembly position | 84 | Grip |
| 62 | Locked position | 85 | Buttstock/shaft |
| 63 | Unlocking cam | 90 | Weapon center plane |

-continued

| | | | |
|---|---|---|---|
| 64 | Unlocked position | 91 | Forward barrel direction-front |
| 65 | Locking cam | 92 | Transverse direction-left |
| 66 | Disassembly position | 93 | Vertical direction (up) |

The invention claimed is:

1. A breechblock for a firearm, where the firearm includes a barrel axis and a barrel extension, the breechblock comprising:

a bolt with a cam pin and a cam pin axis;

a bolt carrier, the bolt carrier having at least one end face, an assembly groove, and a substantially S-shaped cam slot with a locked position and an unlocked position;

wherein the assembly groove is substantially U-shaped or J-shaped with two legs that are substantially oriented in the direction of the barrel axis; and that one of the two legs of the U-shaped assembly groove, or a shorter leg of the J-shaped assembly groove, adjoins the locked position of the cam slot substantially from behind relative to a forward barrel direction.

2. The breechblock according to claim 1, wherein the assembly groove includes a first section that, starting at the end face, extends rearwards and a second section adjoining the first section that extends in a circumferential direction around the barrel axis, and a third section adjoining the second section and extending forward in the forward barrel direction.

3. The breechblock according to claim 2, wherein the cam pin has a cam pin diameter; and the third section of the assembly groove, when viewed in the forward barrel direction and adjacent to the locked position of the cam, extends in a rearward direction for 0.1 to 3 times the diameter of the cam pin.

4. The breechblock according to claim 2, wherein the cam pin has a cam pin diameter; and the third section of the assembly groove, when viewed in the forward barrel direction and adjacent to the locked position of the cam, extends in a rearward direction for 0.5 to 1.5 times the diameter of the cam pin.

5. The breechblock according to claim 2, wherein the first section of the assembly groove extends rearwards parallel to the barrel axis.

6. The breechblock according to claim 2, wherein the second section of the assembly groove, viewed in the forward barrel direction, defines a segment of a circular arc.

7. The breechblock according to claim 6, wherein the defined circular arc segment, when viewed from above, is perpendicular to the barrel axis.

8. The breechblock according to claim 2, wherein the third section of the assembly groove extends in the forward barrel direction completely parallel to the barrel axis.

9. The breechblock according to claim 1, wherein the cam slot at the locked position and the assembly groove at a corresponding end of the leg have equal widths.

10. The breechblock according to claim 1, wherein the cam pin axis of the cam pin when in an assembly position in the first section of the assembly groove is arranged at an angle α to a weapon center plane, wherein the angle α is 20° to 65°, and the cam pin axis of the cam pin in the unlocked position at the front, closed end of the cam slot is at an angle γ on the cam pin axis of the cam pin when in the assembly position, wherein the angle γ is 50° to 120°, and whereby the two angles α and γ lie on different sides of the weapon center plane.

11. The breechblock according to claim 10, wherein the angle α is 35° to 45°.

12. The breechblock according to claim 10, wherein the angle γ is 80° to 100°.

13. The breechblock according to claim 1, wherein the bolt carrier includes at least one guiding groove that guides the bolt carrier along a guide rail of a receiver, intersects the cam slot, and releases the bolt carrier upward.

14. The breechblock according to claim 13, wherein the guiding groove guides the bolt carrier along a guide rail of an upper receiver part.

15. The breechblock according to claim 13, wherein the cam pin includes at its outer end a tapered surface that, when the camp pin is in the unlocked position, is arranged parallel to the guide rail and flush with the guiding groove.

16. The breechblock according to claim 1, wherein the cam pin is formed integrally on the bolt.

17. The breechblock according to claim 16, wherein a transition from the bolt to the cam pin includes a concave recess.

18. The breechblock according to claim 16, wherein a transition from the bolt to the cam pin includes a lens-shaped concave recess.

19. The breechblock according to claim 1, further comprising a firing pin arranged in a firing pin bore in the bolt, such that a firing pin spring arranged around the firing pin is supported on the bolt and preloads the firing pin, wherein in an assembled state the firing pin is supported on the bolt carrier in such a way that the cam pin can be brought on the bolt out of the cam slot into the assembly groove only against a spring force of the firing pin spring.

* * * * *